United States Patent [19]

Pröbstl et al.

[11] 3,938,265

[45] Feb. 17, 1976

[54] MOCASSIN-TYPE SHOE

[75] Inventors: Robert Pröbstl, Walheim; Robert Reiter, Schrozberg; Karl Vogelmann, Besigheim, all of Germany

[73] Assignee: Messrs. Sioux Schuhfabriken Peter Sapper, Walheim, Germany

[22] Filed: Mar. 12, 1975

[21] Appl. No.: 557,767

[30] Foreign Application Priority Data

Mar. 14, 1974 Germany ..... 2412206

[52] U.S. Cl. ..... 36/11

[51] Int. Cl.[2] ..... A43B 3/14

[58] Field of Search ..... 36/2.5 R, 11

[56] References Cited

UNITED STATES PATENTS

| | | | |
|---|---|---|---|
| 1,102,279 | 7/1914 | Luzenski | 36/11 |
| 1,139,153 | 5/1915 | Bass | 36/11 |
| 3,471,948 | 10/1969 | Nadler | 36/11 |

*Primary Examiner*—Patrick D. Lawson

[57] ABSTRACT

A shoe of mocassin-type wherein the border region of the vamp apron is rolled over the edge of the upper, the vamp apron and the upper being stitched together by a seam having two substantially parallel rows of holes in the border region of the vamp apron and a row of holes which in the finished shoe is situated between the two substantially parallel rows of holes and close to the edge of the upper. In order to ensure in such a shoe perfect fluidtightness of the mocassin seam connecting the vamp apron and the edge of the upper, a sealing strip of resilient compressible material is inserted between the inner row of holes of the vamp apron and the row of holes on the upper, the stitching seam passing through the resilient strip and, in the finished shoe, compressing the strip.

8 Claims, 5 Drawing Figures

MOCASSIN-TYPE SHOE

The invention relates to a mocassin-type shoe. In these shoes the edge of the vamp apron is rolled over the edge of the upper and a seam, of stitching, which may give the appearance of plaiting, is used to join the vamp apron and the upper. For this purpose two substantially parallel rows of holes are formed in the border region of the vamp apron and a row of holes, which in the finished shoe is situated between the two substantially parallel rows of holes, are formed near the edge of the upper.

Provided the uppers are suitably impermeable there are essentially two locations in the so-called mocassin shoes through which water could enter the shoe under conditions of wet weather or on other occasions. One such location is the region where the upper is sewn to the sole in some manner. But at this location a perfect seal can be obtained by a suitable jutting out of the sole and reliable gluing in the region of the seam.

The other position, where it has so far not been found possible to ensure a perfect seal against the penetration of water, for example when running on a dewey meadow, is the seam which connects the front part of the upper and the vamp apron. At this location penetration by water can occur after a short period while in the remaining area of the upper no moisture is yet noticeable. It is true that it has already been tried to obtain a seal by applying adhesive in the region of the upper edge of the upper. But satisfactory results can then only be achieved when the edge of the vamp apron is appropriately firmly drawn toward the upper edge of the upper by the seam, which in many cases impairs the appearance of the shoe, so that this waterproofing method is not satisfactory. Moreover, when adhesive is used there is a risk of the glued connection bursting when the shoe is worn and then a perfect seal is no longer ensured; in this context it should be noted that when a mocassin seam is being pleated creases generally result in the region of the vamp apron.

According to the present invention, we provide a mocassin type shoe comprising an upper having upwardly turned edge portions, a row of holes adjacent said edge in the forward part of the shoe, a vamp apron rolled over said forward part of the edge of the upper, an inner and an outer substantially parallel row of holes in the border region of said vamp apron, a sealing strip of resilient compressible material inserted between the inner row of holes of the vamp apron and the row of holes on the upper, and a stitching seam passing through the resilient strip and through the holes of the upper and the holes of the inner and outer rows of the vamp apron, and compressing the strip between the vamp apron and the upper.

With such a construction it is possible to produce a mocassin shoe in which a perfect sealing of the seam connecting the vamp apron and the edge of the upper is ensured. This seal can be obtained in a simple manner during the manufacturing process without it being necessary to turn the upper over.

Thus the invention proceeds from the concept of creating the seal between the vamp apron and upper edge of the upper via an additional sealing strip which is sewn in at the time of producing the mocassin seam. It is obviously sufficient for this strip on the one hand to seal the edge of the upper in the region of its row of holes and on the other hand to seal the vamp apron in the region of its inner row of holes toward the inside of the shoe. Since the outer row of holes is situated outside the upper, penetration of water at this location is not detrimental. Clearly, such a sealing strip, when it is fastened to the vamp apron or to the edge of the upper for example, can be readily sewn in at the time of production of the mocassin seam, so that additional and complicated working steps are avoided. It is nevertheless possible, as tests have shown, to achieve a reliable sealing of the mocassin seam against penetration of water when a suitably formed sealing strip is faultlessly applied. It has been found that with a shoe designed in accordance with the invention, the water first enters through the uppers before it is capable of running into the shoe in the region of the mocassin seam. Thus, when a shoe is designed in accordance with the invention a reliable sealing of the mocassin seam is for the first time obtained, the additional costs, which after all only consist in obtaining the sealing strip, being extremely low. A procedure according to the invention makes it for the first time possible to produce even winter boots of the mocassin type of construction without fear of undesired penetration of water. It is essential for the sealing strip to consist of resiliently compressible material and for it to be compressed by the mocassin seam, since a perfect seal can then be obtained merely by the slight compression of the sealing strip at the time of production of the mocassin seam, without any further measures being required.

A sealing strip which is substantially triangular in cross-section is preferably utilised, a first surface of the triangular strip covering the inner row of holes of the vamp apron and a second surface covering the row of holes of the upper. Such a sealing strip has the advantage of barely swelling upon its being sewn into the mocassin seam in the portion of the roll formed by the seam and situated at the upper side of the shoe, while on the other hand the thicker portion of the strip formed, so to speak, by the base of the triangle is adequately compressed during the sewing-in procedure to ensure a reliable sealing effect.

When, in such a triangular sealing strip, the free side surface of the sealing strip is of somewhat concave configuration, then no portion of the strip is excessively displaced toward the interior of the shoe whilst the seam is sewn and the sealing strip compressed, which could reduce the comfort of the shoe and possibly even to pressure points.

Advantageously, the first surface of the triangular sealing strip is adhesively affixed to the vamp apron such that it overlaps the inner row of holes on both sides thereof. This adhesive connection of the sealing strip and the vamp apron is, of course, effected prior to the vamp apron being sewn into the front portion of the upper. The adhesive connection thus, on the one hand, provides the advantage of the sealing strip being reliably maintained in its place during sewing of the mocassin seam, and on the other hand the adhesive or other manner of securing the triangular strip precisely over the inner row of holes of the vamp apron contributes to a further improvement of the fluid-tightness, although in most cases this would not be necessary at all.

Foam rubber or a material of similar effectiveness has proved particularly advantageous as material for the compressible sealing strip.

According to a further embodiment of the invention it is possible to proceed in such a manner that the sealing strip is substantially T-shaped, the T-web portion engaging between the vamp apron and the edge of the upper while the T-cross beam portion covers the region of the mocassin seam facing the interior of the shoe. When such a sealing strip is carefully positioned in, then a satisfactory waterproofing effect is also obtained. This effect is particularly good when the sealing strip is adhesively affixed to the edge of the upper and to the vamp apron in at least the region of the T-cross beam portion. The adhesive connection can be made in any of the known manners so that it is not necessary to deal in greater detail with the method of producing it.

In order that the invention will more readily be understood, the following description of two preferred embodiments of a shoe according to the invention is given, reference being made to the accompanying drawings, in which.

Figure 1:
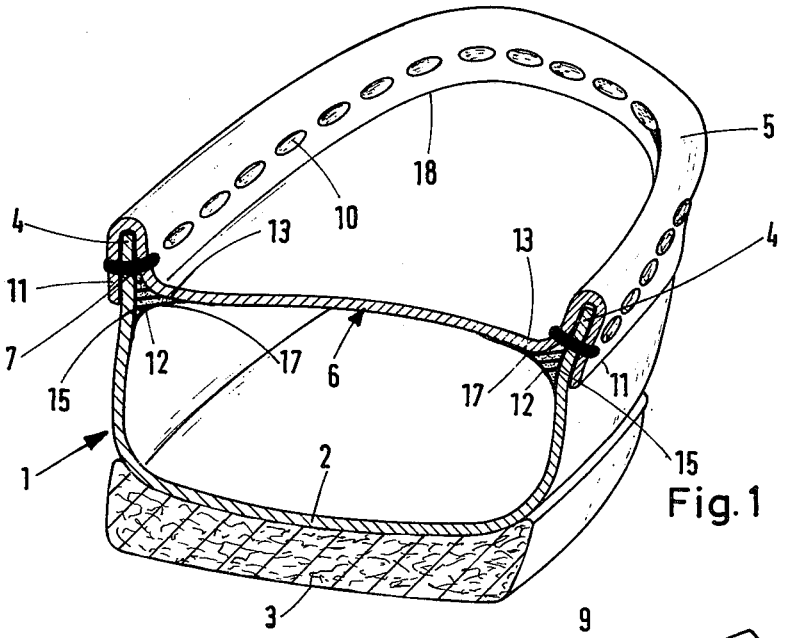
FIG. 1 is a perspective view of a section of the front portion of a first embodiment of mocassin shoe according to the invention.

The shoe of mocassin type construction, the front portion of which is illustrated in section in FIG. 1, has an upper generally designated by the numeral 1, the portion 2 of which extends below the foot. A running sole 3 is attached in the region 2 of the upper 1 in some manner which is of no importance for the invention and is, therefore, not described in greater detail.

The edge of a vamp apron 6 is rolled over the upper edge 4 of the upper, forming a roll 5.

Figure 2:
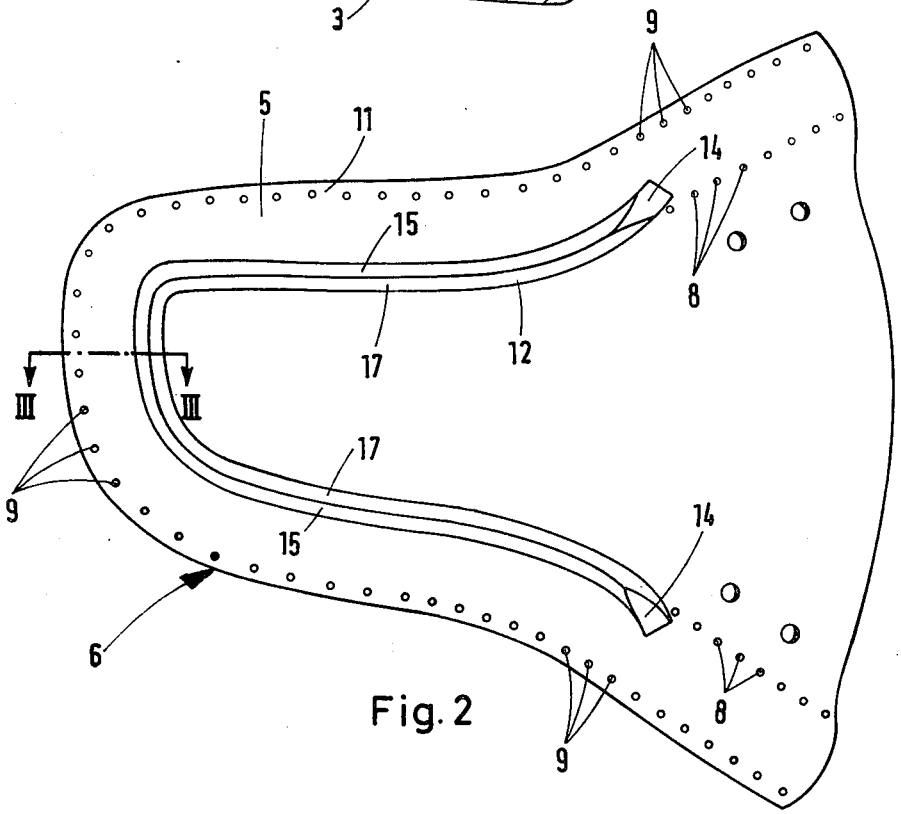
FIG. 2 is a plan view of the internal side of the vamp apron used in the shoe of FIG. 1, prior to its being incorporated in the shoe.

For the purpose of connecting the edge 4 of the upper to the vamp apron 6 the edge of the upper has a row of holes 7. Further, the vamp apron 6 is also provided with two rows of holes, i.e. an inner row of holes 8 and an outer row of holes 9 (FIG. 2). For the purpose of forming the mocassin seam 10 the edge of the vamp apron 6 is folded over the upper edge 4 of the upper in a manner which is apparent from FIGS. 1, 4 and 5. A thread for forming the seam 10 is then passed through the two rows 8, 9 of the vamp apron 6 and the row of holes 7 in the upper edge 4 of the upper situated therebetween, whereby the edge 4 of the upper and the rim 11 of the vamp apron 6 are moved from the position shown in broken lines in FIG. 4 to that shown in solid lines in FIG. 4.

The above description conforms to the conventional shoe of mocassin type. A shoe according to the invention differs only in that a sealing strip 12 (in FIGS. 1 to 4) or 12′ (in FIG. 5) is sewn in between the upper edge 4 of the upper and the inner row of holes 8 of the vamp apron. This sealing strip 12, 12′ effects a seal of the possible water passages formed by the holes of the row of holes 7 in the edge 4 of the upper and in the vamp apron 6.

Figure 3:
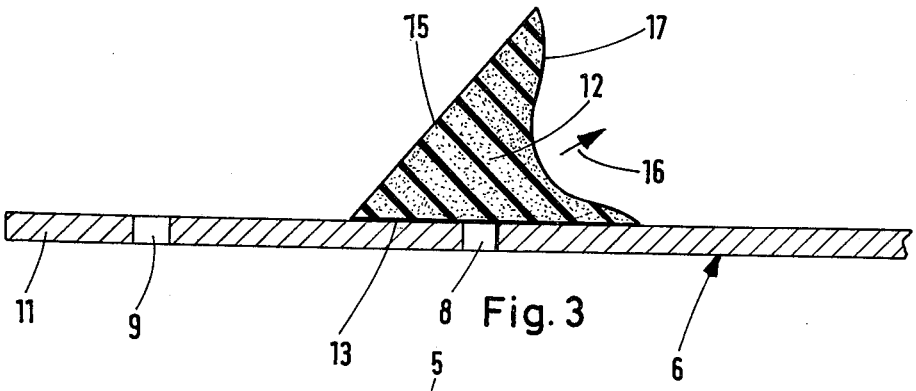
FIG. 3 is a section taken along line III—III of FIG. 2.

In the embodiment illustrated in FIGS. 1 to 4 the sealing strip 12 is of substantially triangular configuration in cross-section (FIG. 3). As is clearly apparent from FIG. 3 its first side surface 13 covers the inner row of holes 8 of the vamp apron 6. To this end the sealing strip 12 is customarily glued to the inside of the vamp apron 6 prior to production of the mocassin seam, in the manner apparent from FIG. 2. As can be seen in FIG. 2 the two ends of the sealing strip 12 may be chamfered at 14 for the purpose of forming a good transition.

Figure 4:
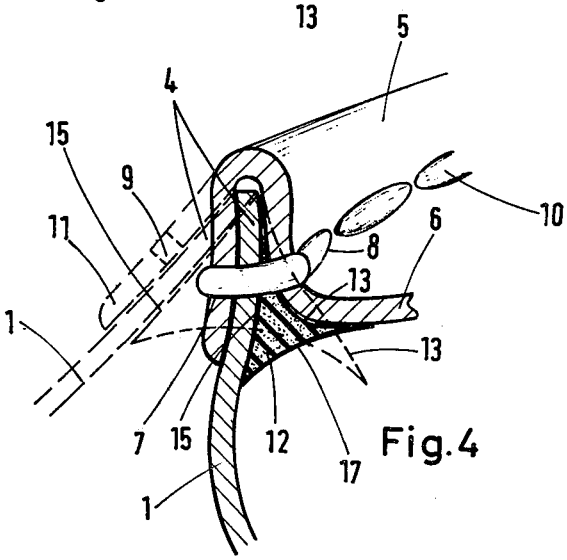
FIG. 4 is a section through the mocassin seam between the vamp apron and upper in the finished state, the components being additionally indicated in that position which they assume before the mocassin seam is applied.

The second side surface 15 of the sealing strip 12 adheres from the inside to the upper edge 4 of the upper and thus seals the row of holes 7 in the upper 1 against penetration of water. The sealing strip 12 which is triangular in cross-section consists of a compressible material, for example foam rubber. Upon compression during production of the seam 10, as is apparent from FIG. 4, the material is displaced from the interior of the sealing strip 12 in the direction of the arrow 16 of FIG. 3. In order now to ensure that the sealing strip 12 does not undesirably swell or bulge inside the shoe the third side surface 17 of the sealing strip 12 is of slightly concave configuration, as can be clearly seen in FIG. 3. In the compressed sealing strip 12 there thus results substantially the contour of the third side surface 17 which is shown in FIG. 4.

It can readily be understood that no additional operational expenditure is required for sewing in the sealing strip 12, which, according to FIGS. 2 and 3, has been adhesively affixed to the vamp apron 6 in the region of the inner row of holes 8 thereof, at the time of sewing of the seam 10. The adhesive application of the sealing strip 12 can also be performed with little expenditure of labour.

When the sealing strip 12 is suitably designed it is optionally possible to obtain, apart from the sealing effect, an additional effect, i.e. that, by virtue of the action of the compressible sealing strip 12, a particularly clean formation of the edge 18 at the inner side of the roll is obtained in the production of the sewn seam 10.

Figure 5:
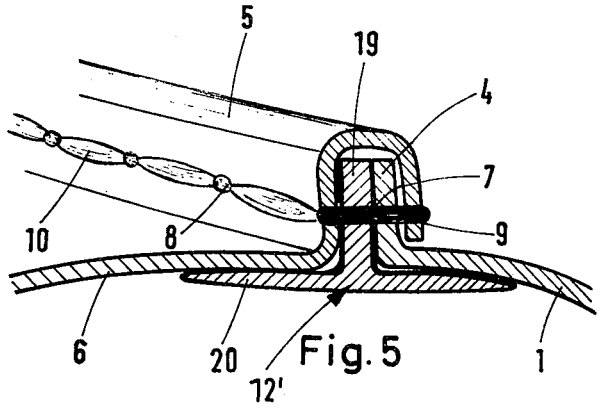
FIG. 5 is a scrap cross-section of a further embodiment of a mocassin seam with a seal according to the invention.

FIG. 5 shows a further embodiment of a shoe according to the invention provided with a sealing strip, which may be of advantage in certain cases of application. In this embodiment the sealing strip 12′ is in cross-section substantially T-shaped. The web portion 19 of the sealing strip 12′ engages between the upper edge 4 of the upper and the region of the vamp apron 6 carrying the inner row of holes 8. Under certain circumstances the mere sewing of this web portion 19 may suffice perfectly to seal the mocassin seam 10. But in order additionally to improve the sealing effect the parts of the cross-beam portion 20 which project at either side from the web portion 19 somewhat overlap the upper 1 and the vamp apron 6. These may be adhesively secured to the upper 1 and/or the vamp apron 6. Provided the sealing strip 12′ also consists of a waterproof material a reliable seal is obtained also in this manner. Actually, the embodiment of FIG. 5 will generally only be employed when a shoe is lined, since the cross-beam portion 20 is relatively broad and therefore conspicuous.

It can readily be seen that many possibilities of modifications exist which relate more particularly to the kind of material of the sealing strip and its cross section.

We claim:

1. A mocassin type shoe comprising an upper having upwardly turned edge portions, a row of holes adjacent said edge in the forward part of the shoe, a vamp apron rolled over said forward part of the edge of the upper, an inner and an outer substantially parallel row of holes in the border region of said vamp apron, a sealing strip of resilient compressible material inserted between the inner row of holes of the vamp apron and the row of holes on the upper, and a stitching seam passing through the resilient strip and through the holes of the upper and the holes of the inner and outer rows of the vamp apron, and compressing the strip between the vamp apron and the upper.

2. A mocassin type shoe as claimed in claim 1, wherein the sealing strip is of a substantially triangular cross-section, having first, second and third surfaces, the first surface covering the inner row of holes of the vamp apron and the second surface covering the row of holes of the upper.

3. A mocassin type shoe as claimed in claim 2, wherein the third surface of the sealing strip is formed to be slightly concave.

4. A mocassin type shoe as claimed in claim 2, wherein the first surface of the sealing strip is secured to the vamp apron in overlapping relation to the inner row of holes thereof.

5. A mocassin type shoe as claimed in claim 4, wherein the sealing strip is secured to the vamp apron adhesively.

6. A mocassin type shoe as claimed in claim 1, wherein the sealing strip consists of a foam material.

7. A mocassin type shoe as claimed in claim 1, wherein the sealing strip is of a substantially T-shaped cross-section, having a web portion and a crossbeam portion, the web portion engaging between the vamp apron and the upper, while the crossbeam portion covers the region of the seam facing inwardly of the shoe.

8. A mocassin type shoe as claimed in claim 7, wherein the cross-beam portion of the sealing strip is adhesively secured to the edge of the upper and to the vamp apron.

* * * * *